US009517616B2

(12) United States Patent
Mueller et al.

(10) Patent No.: US 9,517,616 B2
(45) Date of Patent: Dec. 13, 2016

(54) LIFTING SUCKER WITH PNEUMATICALLY CONTROLLABLE SUCTION CUP AND PUNCH AND SHEET-FED ROTARY PRINTING PRESS HAVING THE LIFTING SUCKER

(71) Applicant: HEIDELBERGER DRUCKMASCHINEN AG, Heidelberg (DE)

(72) Inventors: Andreas Mueller, Heidelberg (DE); Jochen Renner, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/628,441

(22) Filed: Feb. 23, 2015

(65) Prior Publication Data

US 2015/0239235 A1 Aug. 27, 2015

(30) Foreign Application Priority Data

Feb. 21, 2014 (DE) ..... 10 2014 002 470

(51) Int. Cl.

| | |
|---|---|
| ***B65H 3/08*** | (2006.01) |
| ***B41F 21/06*** | (2006.01) |
| ***B65H 37/00*** | (2006.01) |

(52) U.S. Cl.

CPC ..... *B41F 21/06* (2013.01); *B65H 3/0808* (2013.01); *B65H 3/0883* (2013.01); *B65H 37/00* (2013.01); *B65H 2406/332* (2013.01); *B65H 2406/343* (2013.01); *B65H 2801/21* (2013.01)

(58) Field of Classification Search

CPC ..... B65H 3/0816; B65H 3/0883; B65H 2406/332

See application file for complete search history.

(56) References Cited

U.S. PATENT DOCUMENTS

| | | | | |
|---|---|---|---|---|
| 4,717,138 | A | 1/1988 | Watkiss | |
| 4,917,427 | A | 4/1990 | Scaglia | |
| 5,056,464 | A * | 10/1991 | Lewis | A01K 45/007 119/6.8 |
| 6,612,633 | B1 * | 9/2003 | Tell | B65G 47/91 294/186 |
| 7,014,185 | B2 | 3/2006 | Oestreicher et al. | |
| 8,042,465 | B2 * | 10/2011 | Schmidt | B41F 21/106 101/230 |

FOREIGN PATENT DOCUMENTS

| | | | |
|---|---|---|---|
| DE | 1431877 | C3 | 2/1975 |
| DE | 29713002 | U1 | 9/1997 |
| DE | 19628943 | C2 | 10/1999 |
| DE | 19752491 | C2 | 2/2001 |
| EP | 0302221 | A1 | 2/1989 |
| GB | 1045507 | A | 10/1966 |

* cited by examiner

*Primary Examiner* — Howard Sanders

(74) *Attorney, Agent, or Firm* — Laurence A. Greenberg; Werner H. Stemer; Ralph E. Locher

(57) ABSTRACT

A lifting sucker for separating sheets from a sheet stack includes a suction cup formed as a double-walled bellows sucker having at least one suction chamber that can be acted on pneumatically to contract the bellows sucker. A punch and a sheet-fed rotary printing press having the lifting sucker are also provided.

18 Claims, 6 Drawing Sheets

LIFTING SUCKER WITH PNEUMATICALLY CONTROLLABLE SUCTION CUP AND PUNCH AND SHEET-FED ROTARY PRINTING PRESS HAVING THE LIFTING SUCKER

CROSS-REFERENCE TO RELATED APPLICATION

This application claims the priority, under 35 U.S.C. §119, of German Patent Application DE 10 2014 002 470.9, filed Feb. 21, 2014; the prior application is herewith incorporated by reference in its entirety.

BACKGROUND OF THE INVENTION

Field of the Invention

The invention relates to a lifting sucker having a pneumatically controllable suction cup. Lifting suckers of that type are predominantly used in sheet processing machines, such as printing presses or punching systems, for separating the sheets from a sheet stack. The invention also relates to a punch and a sheet-fed rotary printing press having the lifting sucker.

U.S. Pat. No. 7,014,185 B2 discloses a lifting sucker which substantially includes a cylinder and a tubular piston surrounding the latter coaxially. At one end, the tubular piston has suction nozzles for attracting a sheet from a sheet stack by suction. The sheet is attracted by suction in an extended position of the tubular piston. When the nozzles are covered, a rise in a vacuum in the cylinder takes place, which leads to the piston, together with the sheet, being lifted. Venting the cylinder leads to the sheet being released. The ambient air then sucked in through the nozzle reduces the vacuum in the cylinder, so that the piston is extended in order to attract the next sheet by suction and is placed on the sheet stack.

German Patent DE 196 28 943 C2 discloses forming a suction cup of a separating sucker as a resilient bellows sucker.

German Patent DE 197 52 491 C2 shows a sucker in which a variable suction chamber for lifting the suction cup is delimited by a bellows.

SUMMARY OF THE INVENTION

It is accordingly an object of the invention to provide a lifting sucker with a pneumatically controllable suction cup and a punch and a sheet-fed rotary printing press having the lifting sucker, which overcome the hereinafore-mentioned disadvantages of the heretofore-known devices of this general type.

With the foregoing and other objects in view there is provided, in accordance with the invention, a lifting sucker for separating a sheet from a sheet stack, the lifting sucker comprising a suction cup formed of flexible material and having a suction opening which is enclosed by a double-walled bellows, in which the bellows has at least one suction chamber.

With the objects of the invention in view, there is also provided a lifting sucker for separating a sheet from a sheet stack, the lifting sucker comprising a suction cup formed of flexible material and having a suction opening which is enclosed by a double-walled bellows, in which the bellows has at least one suction chamber with at least one additional suction opening.

With the objects of the invention in view, there is furthermore provided a lifting sucker for separating a sheet from a sheet stack, the lifting sucker comprising a suction cup formed of flexible material and having a suction opening which is enclosed coaxially by a double-walled bellows, in which the bellows is divided into a plurality of suction chambers with additional suction openings and at least one closed suction chamber.

A particular advantage of the invention is that the suction cup is controllable separately, independently of the lifting movement of the lifting sucker. As a result of this measure, the suction cup can be placed softly on the sheet to be lifted. In this way, firstly markings on the sheet are avoided and, secondly, sucking through the sheet can be prevented, which otherwise would result in simultaneous attraction of a second sheet lying underneath by suction.

Further advantageous refinements of the suction cup, which make it possible for the latter to also be adapted to sheets inclined with respect to the horizontal or to curved sheets, are described below.

With the objects of the invention in view, there is concomitantly provided a punch or a sheet-fed rotary printing press, comprising the lifting sucker.

Other features which are considered as characteristic for the invention are set forth in the appended claims.

Although the invention is illustrated and described herein as embodied in a lifting sucker with a pneumatically controllable suction cup and a punch and a sheet-fed rotary printing press having the lifting sucker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
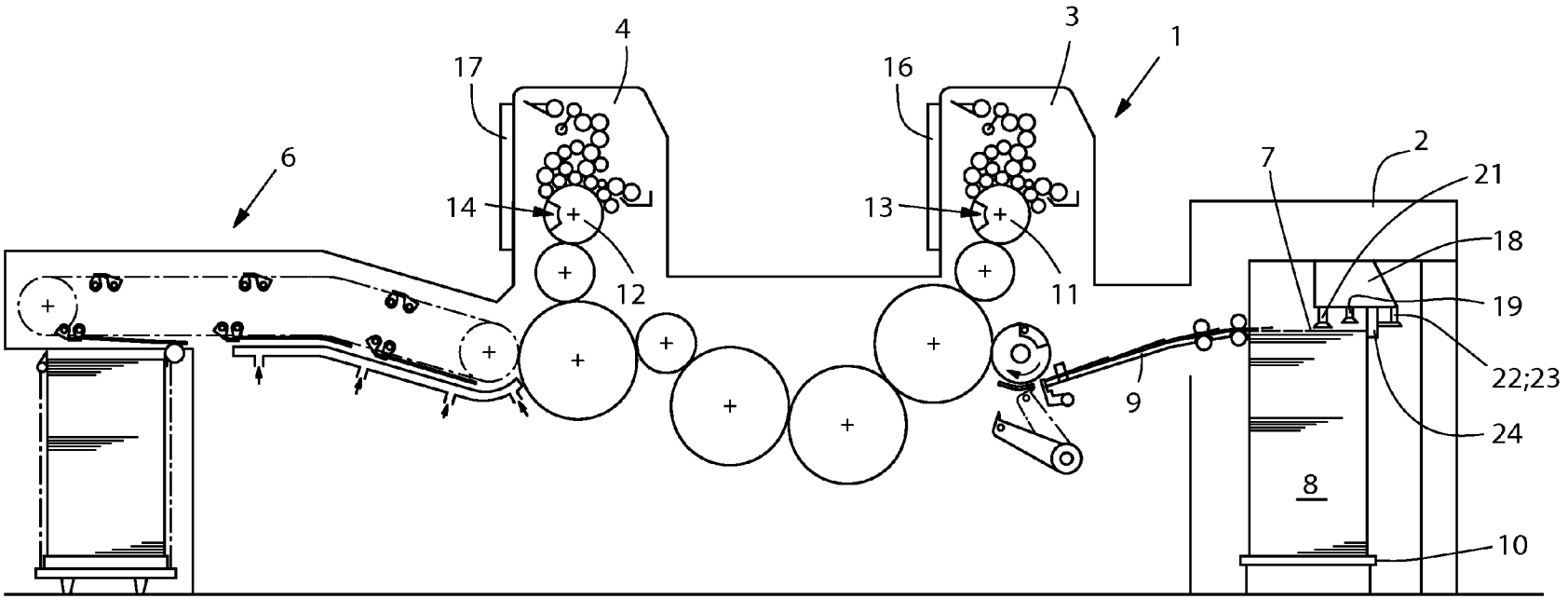
FIG. 1 is a diagrammatic, longitudinal-sectional view of a sheet processing machine.

Referring now to the figures of the drawings in detail and first, particularly, to FIG. 1 thereof, there is seen a machine for processing sheets 7, for example a punch or printing press 1, which has a feeder 2 and a delivery 6. In the printing press, the sheets 7 are removed from a sheet stack 8 and fed in separated or overlapping form over a feed table 9 to printing units 3 and 4. The printing units of the printing press 1 each contain a plate cylinder 11, 12 in a known way. The plate cylinders 11 and 12 each have a device 13, 14 for fixing flexible printing plates. Moreover, each plate cylinder 11, 12 is assigned a device 16, 17 for semi-automatic or fully automatic printing plate changing.

The sheet stack 8 lies on a stack board 10 that can be raised under control. The sheets 7 are removed from the top of the sheet stack 8 by a so-called suction head 18 which, among other things, has a number of lifting and dragging suckers 19, 21 for the separation of the sheets 7. Furthermore, blowing devices 22 for loosening the upper sheet layers and sensing elements 23 for stack tracking are provided. In order to align the sheet stack 8, in particular the upper sheets 7 of the sheet stack 8, a number of side and rear stops 24 are provided.

According to FIGS. 2 and 2A-2C, the lifting sucker 19 is formed as a so-called spring sucker, i.e. a vacuum level required to lift a suction cup 26 is firstly produced as a result of covering a suction opening 43 or a nozzle 27 with the sheet 7. The suction opening 43 or nozzle 27 is disposed on the suction cup 26 and acts on a surface of the sheet 7.

Figure 2A:
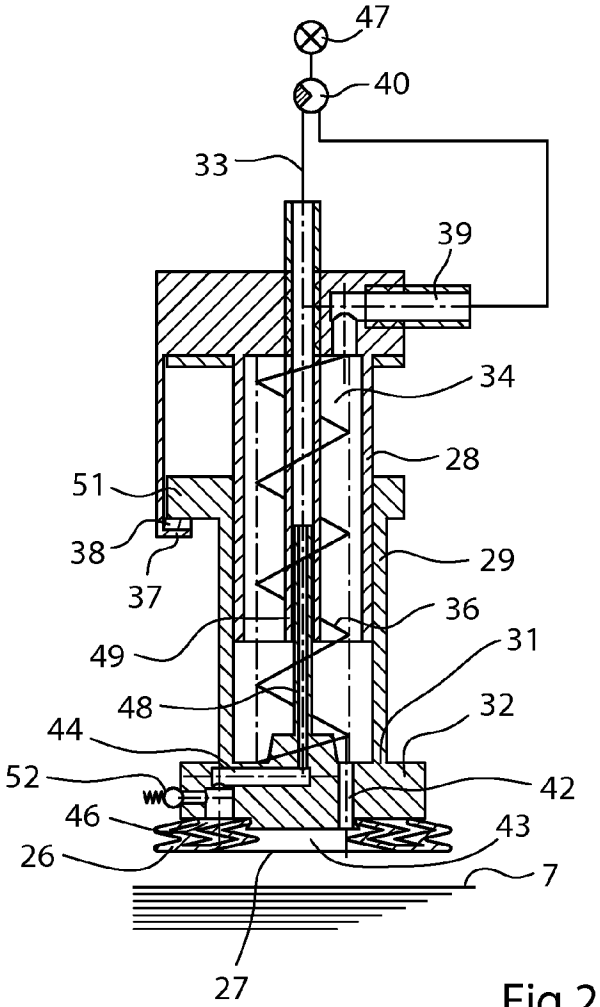
FIGS. 2A, 2B and 2C are longitudinal-sectional views showing the lifting sucker in various working positions.
Figure 2:
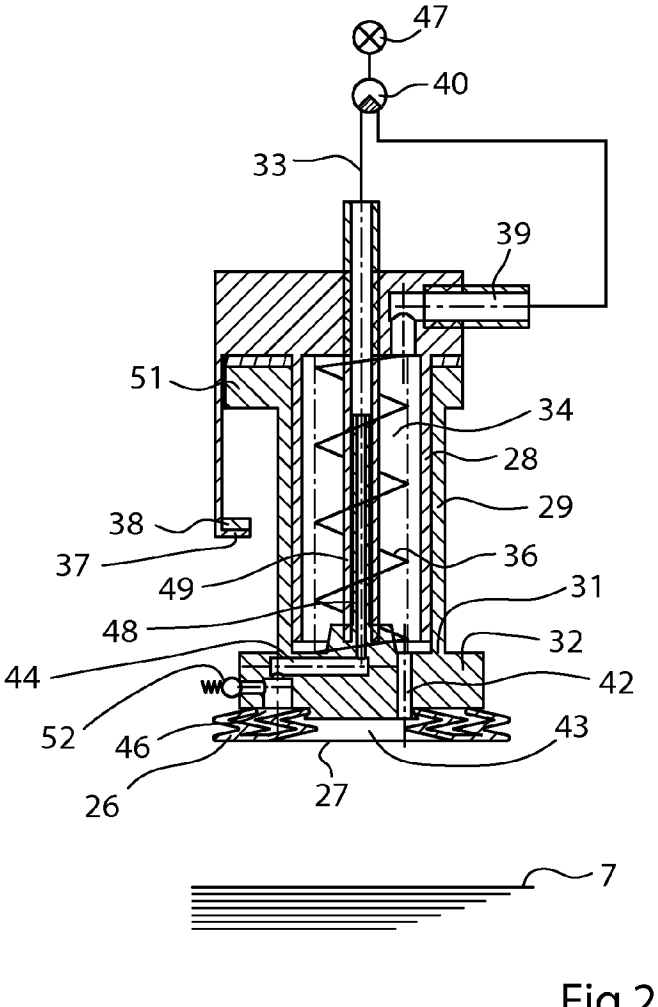
FIG. 2 is a longitudinal-sectional view of a lifting sucker.

As is illustrated in FIG. 2, the lifting sucker 19 includes a cylinder 28, which is used to guide a cylindrical piston 29 that encloses the cylinder 28 coaxially from the outside. The piston 29 has a lower end 31 facing the sheet 7 and carrying a supporting plate 32, on which the suction cup 26 is disposed. The piston 29, together with the cylinder 28, thus has an axis of rotation 33. The cylinder 28 and the piston 29 together form a suction chamber 34 in which a compression spring 36 is disposed that has the task of extending or driving the piston 29 downward in the direction of the sheet 7. A stop 37 with a damper 38 limits the stroke of the piston 29 in an extended end position. A suction air connection 39 connects the suction chamber 34 through a rotary valve 40 to a suction air source 47.

The supporting plate 32 has a first connecting bore 42, which connects the suction chamber 34 to the suction opening 43 of the suction cup 26. The suction cup 26 is formed as a double-walled bellows sucker 30. As a result, the suction opening 43 is enclosed by a suction chamber 46. A second connecting bore 44 in the supporting plate 32 connects the suction chamber 46 of the double-wall bellows sucker 30 to controlled suction air from the rotary valve 40. The second connecting bore 44 has a pipe 48 which is disposed on the axis of rotation 33 and is fixed to the supporting plate 32. The pipe 48 is enclosed coaxially by a pipe 49, which is disposed on the cylinder 28. The pipe 48, together with the piston 29, can be displaced longitudinally with respect to the pipe 48, so that the two pipes 48 and 49 are mounted in such a way that they can be displaced telescopically in each other.

FIG. 2 shows the lifting sucker 19 in an upper position, in which both the suction chamber 34 and the chamber 46 have a vacuum applied to them.

In the next step, the lifted sheet 7 is drawn away from the suction cup 26, so that the suction chamber 34 is vented. A suitable mechanical, magnetic or pneumatic device holds the piston 29 in the upper position. One example is shown by German Patent DE 42 34 184 C2, corresponding to U.S. Pat. No. 5,447,300. Following the release of the holding device, the piston is moved downward by its own weight and the force of the compression spring 36, until a collar 51 of the piston 49 is stopped by the stop 37, as is illustrated in FIG. 2A. The rotary valve 40 then vents the suction chamber 46 of the suction cup 26, so that the suction cup 26 extends as a result of the tensile force of the chamber walls and places the suction cup 26 on the sheet 7, as is illustrated in FIG. 2B. A positive pressure possibly arising in the chamber 46 in this case can escape through a restrictor with a non-return valve 52.

Figure 2C:
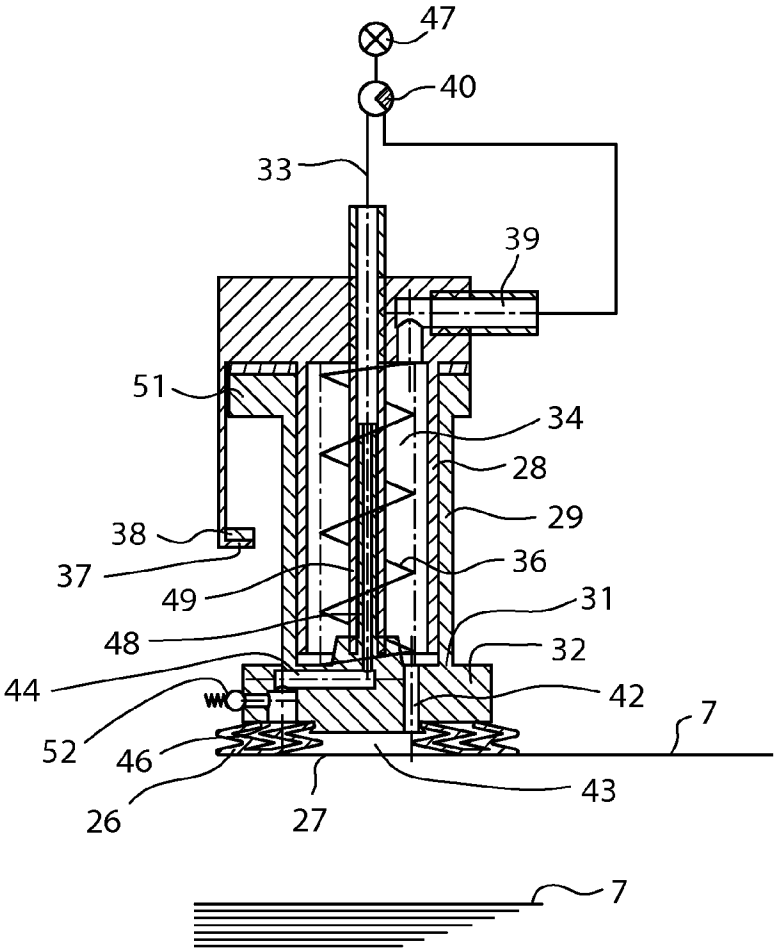
Figure 2B:
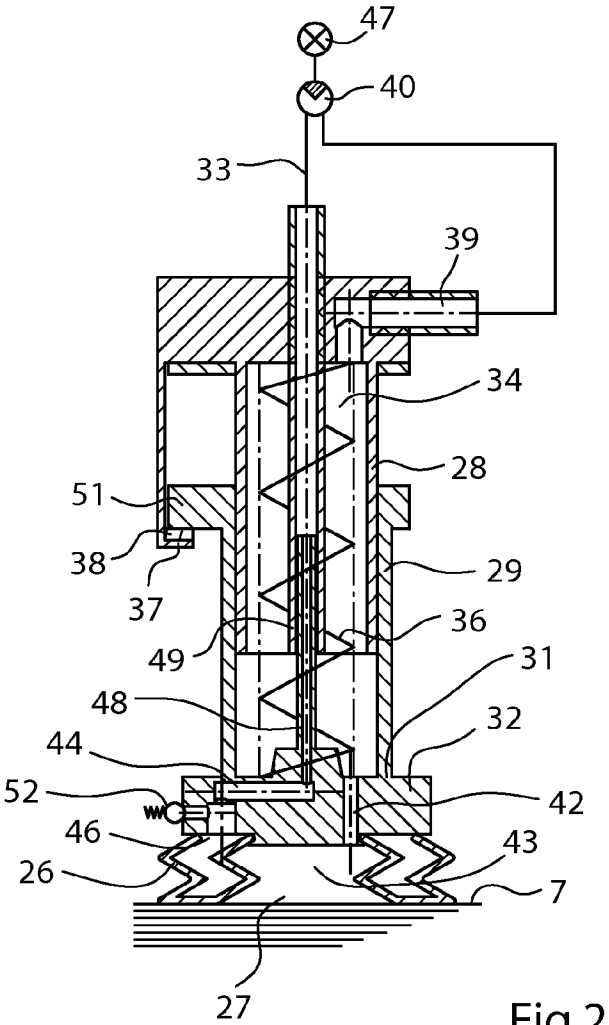

In order to attract the new sheet 7 by suction, the rotary valve 40 supplies the suction chamber 46 and the suction chamber 34 with vacuum, so that the former are contracted, as shown in FIG. 2C, and the suction cup 26 and the piston 29 are lifted into the upper position.

Figure 3:
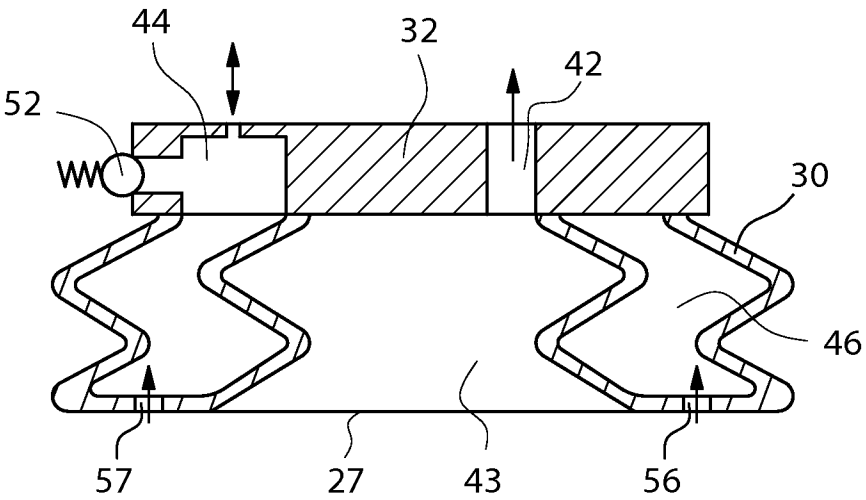
FIG. 3 is an enlarged sectional view of a suction cup of the lifting sucker.

FIG. 3 shows the suction cup 26 of the lifting sucker 19 having the double-walled bellows sucker 30 with the suction chamber 46 receiving air through suction openings 56, 57.

Figure 4A:
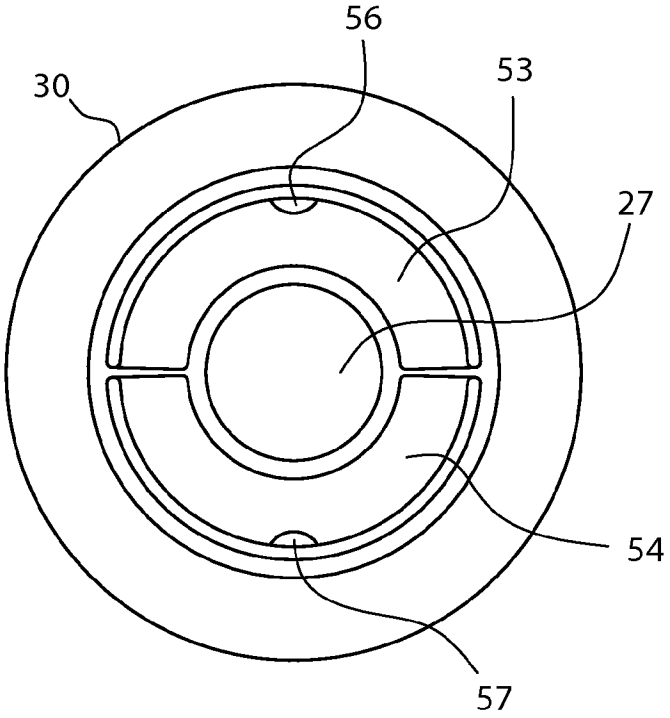
FIG. 4A is a cross-sectional view of the suction cup having two bellows suction chambers.
Figure 4:
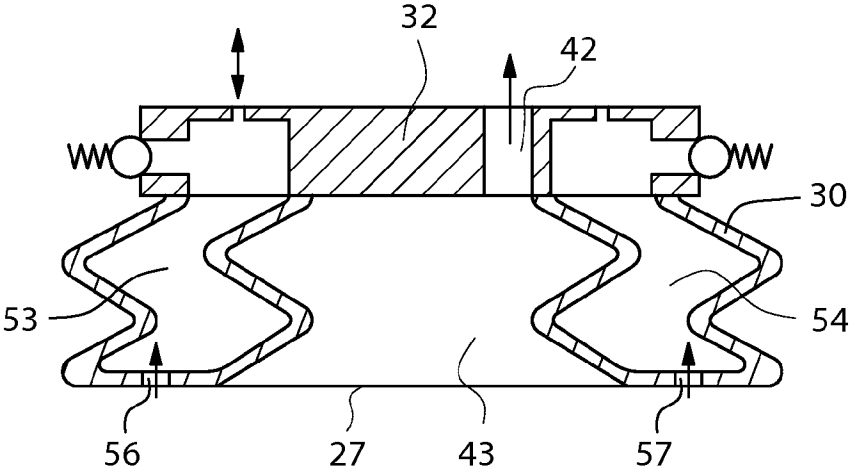
FIG. 4 is a view similar to FIG. 3 of a suction cup having two bellows suction chambers.

In an exemplary embodiment according to FIGS. 4 and 4A, provision is made for the double-walled bellows 30 to have at least two suction chambers 53, 54, each having a suction opening 56, 57.

The suction chambers 53, 54 can have suction air applied to them independently of the suction opening 27. As a result of this measure, a suction cup 26 placed obliquely on a sheet can already exert a suction action on the sheet 7 through one of the suction openings 56 or 57, even if the main suction opening 27 is not yet completely covered. When one of the suction openings 56 or 57 is covered, at the same time the bellows in the region of the suction opening 56 or 57 contracts, and thus the sheet is lifted.

Figure 5:
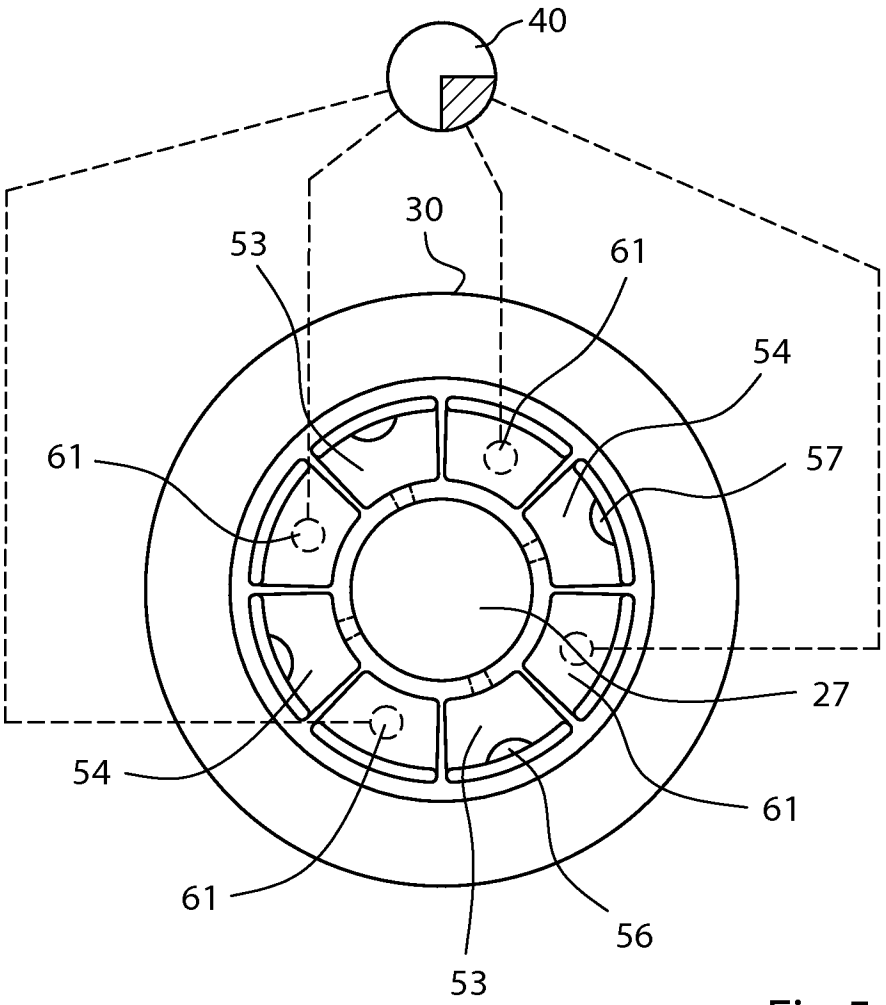
FIG. 5 is a cross-sectional view of a suction cup having a plurality of bellows suction chambers.

In an exemplary embodiment according to FIG. 5, provision is made for the double-walled bellows 30 to have a plurality of suction chambers 53, 54 with suction openings 56, 57 and closed suction chambers 61, which are disposed alternately around the main suction opening 27. In this case, the suction chambers 53, 54 with suction openings 56, 57 serve to attract the sheet by suction without leakage, while the closed suction chambers 61 can have control air, i.e. either blown or suction air, applied thereto in order to influence a stroke of the bellows sucker 30.

In the case of a configuration of a plurality of closed suction chambers 61, provision can be made to activate the latter one after another through the rotary valve 40, for example at the cycle rate of the sheet processing machine, so that a deliberate inclined position of the suction cup 26 is made possible.

In the exemplary embodiment according to FIG. 5, the operating cylinder and piston 28, 29 illustrated in FIGS. 2-2C can be omitted, since the lifting movement is controlled by the pneumatic action on the closed suction chambers 61.

The invention claimed is:

1. A lifting sucker for separating a sheet from a sheet stack, the lifting sucker comprising:

a suction cup formed of flexible material and having a suction opening formed therein; and a double-walled bellows defining said suction cup and enclosing said suction opening, said bellows having a mounting end, said bellows having an inner wall with an inner wall distal end opposite said mounting end and an outer wall with an outer wall distal end opposite said mounting end, said bellows having a ring-shaped end wall connected between said inner wall distal end and said outer wall distal end for defining at least one suction chamber.

2. The lifting sucker according to claim 1, which further comprises a non-return valve connected to said at least one suction chamber.

3. A punch, comprising a lifting sucker according to claim 1.

4. A sheet-fed rotary printing press, comprising a lifting sucker according to claim 1.

5. The lifting sucker according to claim 1, further comprising a support plate having said mounting end disposed thereon, said support plate having a connecting bore formed therein within a periphery of said suction opening for supplying suction to said suction opening.

6. A lifting sucker for separating a sheet from a sheet stack, the lifting sucker comprising:

a suction cup formed of flexible material and having a suction opening formed therein; and a double-walled bellows defining said suction cup and enclosing said suction opening, said bellows having a mounting end and a distal end for engaging the sheet, said bellows having an inner wall and an outer wall, said bellows having a ring-shaped end wall at said distal end, said ring-shaped end wall connecting said inner wall with said outer for defining at least one suction chamber, said ring-shaped end wall having at least one additional suction opening formed therein.

7. The lifting sucker according to claim 6, which further comprises a non-return valve connected to said at least one suction chamber.

8. A punch, comprising a lifting sucker according to claim 6.

9. A sheet-fed rotary printing press, comprising a lifting sucker according to claim 6.

10. The lifting sucker according to claim 6, further comprising a support plate having said mounting end disposed thereon, said support plate having a connecting bore formed therein within a periphery of said suction opening for supplying suction to said suction opening.

11. A lifting sucker for separating a sheet from a sheet stack, the lifting sucker comprising:

a suction cup formed of flexible material and having a suction opening formed therein; and a double-walled bellows defining said suction cup and coaxially enclosing said suction opening, said bellows being divided into at least one closed suction chamber and into a plurality of suction chambers with additional suction openings formed therein.

12. The lifting sucker according to claim 11, which further comprises a rotary valve, said at least one closed suction chamber including a plurality of closed suction chambers alternating with said plurality of suction chambers coaxially around said suction opening and having suction air applied successively thereto in common from said rotary valve.

13. The lifting sucker according to claim 11, wherein said at least one closed suction chamber includes a plurality of closed suction chambers alternating with said suction chambers coaxially around said suction opening and being configured to have suction air applied jointly thereto.

14. The lifting sucker according to claim 11, which further comprises a non-return valve connected to said plurality of suction chambers.

15. A punch, comprising a lifting sucker according to claim 11.

16. A sheet-fed rotary printing press, comprising a lifting sucker according to claim 11.

17. The lifting sucker according to claim 11, wherein said bellows have ends walls defining said at least one closed suction chamber and defining said plurality of suction chambers with additional suction openings formed therein having said additional suction opening formed in said end walls.

18. The lifting sucker according to claim 11, further comprising a support plate mounting said bellows, said support plate having a connecting bore formed therein within a periphery of said suction opening for supplying suction to said suction opening.

* * * * *